US006138995A

United States Patent [19]

Page

[11] Patent Number: 6,138,995

[45] Date of Patent: Oct. 31, 2000

[54] DISPENSE OF BEVERAGE CONTAINING CONTROLLED LEVELS OF DISSOLVED GAS

[75] Inventor: John K. R. Page, Camberley, United Kingdom

[73] Assignee: Permea, Inc., St. Louis, Mo.

[21] Appl. No.: 09/052,297

[22] Filed: Mar. 31, 1998

[51] Int. Cl.[7] ..... B01F 3/04

[52] U.S. Cl. ..... 261/43; 261/53; 261/102; 261/105; 261/122.1; 261/DIG. 7; 210/321.8

[58] Field of Search ..... 261/34.1, 42, 43, 261/53, 64.1, 100, 101, 102, 104, 105, 122.1, DIG. 7; 210/321.8

[56] References Cited

U.S. PATENT DOCUMENTS

| | | | |
|---|---|---|---|
| 3,780,198 | 12/1973 | Pahl et al. | 261/DIG. 7 |
| 4,610,888 | 9/1986 | Teng et al. . | |
| 4,927,567 | 5/1990 | Rudick . | |
| 4,950,431 | 8/1990 | Rudick et al. . | |
| 5,029,733 | 7/1991 | Hedderick et al. . | |
| 5,062,548 | 11/1991 | Hedderick et al. . | |
| 5,236,586 | 8/1993 | Antoni et al. | 210/321.8 |
| 5,565,149 | 10/1996 | Page et al. . | |

FOREIGN PATENT DOCUMENTS 2247225 2/1992 United Kingdom .

OTHER PUBLICATIONS

D.G. Taylor, P. Bamber, J. W. Brown & J.P. Murray /"Uses of Nitrogen in Brewing"/1992/pp. 137–142 (MBAA Technical Quarterly, vol. 29).

A. J. L. Kennedy/Romford Brewery Co./Sep. 24 and 25, 1992 /"The Use of Nitrogen in the Brewing Industry"/pp. 43–50.

*Primary Examiner*—C. Scott Bushey
*Attorney, Agent, or Firm*—Mark L. Rodgers

[57] ABSTRACT

The present invention relates to providing an apparatus and a process for dispensing a beverage from a tap, sometimes as often as about every 8 to 10 seconds, while maintaining a predetermined quantity of dissolved nitrogen and/or dissolved carbon dioxide or other gas utilizing a contactor module containing hollow fiber membranes.

27 Claims, 2 Drawing Sheets

106
104
102
98
96
60
94
90
82
92
84
80
100
68
108
110
112
2
114
72
70
136
115
8
117
3
1
113
66
9
7
122
64
62
120
116
5
124
6
4
118
134
132
130
128
126

DISPENSE OF BEVERAGE CONTAINING CONTROLLED LEVELS OF DISSOLVED GAS

BACKGROUND OF THE INVENTION

The present invention relates to the control of dissolved gases in liquids including beverages and particularly beer and to the dispense of beverages under pressure at a tap or other dispense device. The most common gases to be controlled in the beverages are carbon dioxide and nitrogen. The raising or lowering of a concentration of a gas takes place in a contactor module containing hollow fiber membranes wherein the beverage flows through the shell side or the bore side of the fibers in the module and gas is controlled by partial pressure regulation on the other side of the hollow fibers in the module.

Carbonation of liquids, particularly for beverages, has taken place for many years. Control of the degree of dissolution of carbon dioxide and other gases in liquids has led to a great deal of experimentation. In some instances, nitrogen has been used in the production and packaging of beers and other beverages primarily to exclude oxygen from the feed water and from contact with the final brewed or bottled product. In addition, it has been found desirable to use nitrogen in a dissolved state in alcoholic beverages, particularly beers, so as to influence the presentation of the beer when the beer is dispensed from a tap into the glass or mug.

Depending on the type of beer the carbonation varies, for instance, for a lager beer generally the carbonation level is above about 2.0 volumes of carbon dioxide per volume of liquid, and for the dark stout beers that level is about 1.0. Many customers, particularly in Europe, express a preference for a tight long-lasting head on dispensed beer. In spite of the presence of various long chain molecules in beers, which molecules have surfactant properties, the desired presentation of a tight long lasting head cannot be achieved with only carbon dioxide in solution. This is true because carbon dioxide is able to permeate rapidly through the thin walls of the initially formed bubbles on the surface of a dispensed beer and hence is lost to the atmosphere which contains a low concentration of carbon dioxide.

It would seem that because the carbon dioxide is supersaturated in the beer that the potential reserve of additional carbon dioxide to replace lost gas would be available. However, this is not normally true because the beer is cold and because modern glass washing methods do not create surface scratches and/or leave deposits which will nucleate carbon dioxide from solution after the beer has come to rest in the glass.

It is known that dissolving a quantity of a weakly soluble gas, conventionally nitrogen, in beer prior to dispense provides high quality presentation in the form of a stable white foam head. Because of its low solubility nitrogen gas which has been pre-dissolved in beer at elevated pressure will very rapidly precipitate out of solution when the beer drink flows through the dispense tap. This precipitation is in the form of a very fine dispersion of small bubbles which approaches its new lower equilibrium concentration at atmospheric pressure when the beer is dispensed.

Because these initially formed nitrogen bubbles are very small, they float slowly to the surface of the beer and some nucleate precipitation of dissolved carbon dioxide gas which enters them, causing them to grow and float faster. The small bubbles which collect at the surface thus contain nitrogen and a mixture of carbon dioxide and nitrogen gases. Because nitrogen, in comparison to carbon dioxide, is less able to permeate through the bubble wall, these bubbles are relatively stable, although they are losing carbon dioxide by permeation to the atmosphere. That loss tends to be made up by further carbon dioxide arising from the bulk of the beer in the glass. Hence the "head" on a nitrogenated beer lasts longer and is more appealing to most customers.

At pubs and restaurants, most beers are transferred by means of pressure displacement, often supplied by carbon dioxide creating a high pressure of carbon dioxide in the keg. Fast displacement of beer by use of high carbon dioxide pressure, provides the risk of over carbonation of the beer. Over carbonation can lead to break out of carbon dioxide in the tubing upstream of the dispense tap when dispensing from a keg to a tap if there is a significant pressure drop in the delivery tubing. This leads to beer loss through "fobbing" i.e., production of excess foam before dispense and at the tap. In an attempt to prevent over carbonation a mixture of nitrogen and carbon dioxide gases has been used for pressure dispense of kegged beers. Although this technique helps to lessen the likelihood of over carbonation, control of a precise amount of carbonation is not feasible by this means.

It has been claimed that there is a causal relationship between the use of nitrogen in production and mixed gas in dispense. The reasoning is that if a beer has been nitrogenated initially then it should be dispensed with a mixed gas in order to maintain that nitrogenation to achieve the desired presentation effects. However, there are three implied requirements which are not independently achievable with the mixed gas dispense principle. These requirements are (1) a maximum total head pressure on the keg in order to achieve fast dispense flow rates; (2) the correct partial pressure of carbon dioxide to avoid over carbonation; and (3) the correct nitrogen partial pressure to maintain nitrogenation. No significant amount of nitrogenation of a keg beer will take place from the mixed gas pressure used for transport because at best only an equilibrium of partial pressures will be established and diffusion mobility of dissolved gases is very low in stagnant liquid layers. However, nitrogen can be lost to the head space from an initially nitrogenated beer. Commercial factors dictate in practice that the two most important requirements are a maximum total head pressure on the keg and the correct partial pressure of carbon dioxide. As a result, dispense with mixed gas is always tailored to maintaining beer carbonation and maximizing speed of dispense as opposed to maintaining the correct nitrogen content for the appeal in presentation.

U.S. Pat. No. 5,565,149 provides a process to nitrogenate beer and/or control the carbon dioxide content of the beer. In this patent, certain membrane modules are used to control the dissolution of carbon dioxide and nitrogen in beer and other liquids or beverages. While the gas dissolution is adequately controlled, the speed at which the beer can be dispensed repeatedly while achieving and maintaining the level of nitrogen and carbon dioxide in the beer is not sufficient in certain circumstances. In the reference, it is noted that when drawing the beer from a tap it is necessary to allow at least 40 seconds for the nitrogen and carbon dioxide levels to be reached for the next draw. In a busy tavern, pub or restaurant, it is frequently necessary to draw beer from the tap every 8 or 10 seconds.

The present invention provides a process and apparatus to dissolve gases such as carbon dioxide and/or nitrogen in beer and the like. The present invention will (1) provide the correct partial pressure of carbon dioxide to avoid either high or low carbonation; (2) provide the correct- partial pressure of nitrogen in the beer for a high quality presentation to the customer; and (3) permit rapid draw from a tap as frequently as every 8 or 10 seconds while providing and maintaining the desired dissolved gas content in the drawn beer.

SUMMARY OF THE INVENTION

The present invention provides a process and apparatus for controlling the dissolution of one or more gases in a liquid, generally a beverage which is dispensed under pressure. An apparatus is suitable for dispense of a beverage under pressure as often as about every 8 to 10 seconds, while maintaining a predetermined quantity of dissolved gas in the beverage. The apparatus is comprised of (a) a contactor module containing hollow fiber membranes, the module having a gas side and a liquid side, (b) means for presenting the beverage at a predetermined pressure on the liquid side in the contactor module, (c) a first three-way valve connecting the gas side of the contactor module to either the atmosphere or a second three-way valve, the second three-way valve being connected to a first gas source to provide either high pressure gas or nominal pressure gas for controlling the pressure of a dissolving gas in the gas side of the contactor module, and (d) means for maintaining the gas containing beverage under pressure until dispense.

The present invention also provides a process utilizing the contactor module wherein the beverage is placed in the liquid side of the contactor module under a predetermined pressure, by (a) increasing the quantity of dissolved gas in the beverage by applying a gas from a gas source at a pressure from about 60 to about 90 psig to the gas side in the contactor module for from about 4 to about 8 seconds to obtain a predetermined dissolved level of the gas in bubble-less form in the beverage while continuously maintaining the pressure of the beverage in the contactor module. The pressure is then reduced to a predetermined level and the dissolved gas is retained under pressure in bubble-less form in the beverage until dispense is completed into a glass or mug.

For example, the present invention controls the dissolution of either or both of carbon dioxide and nitrogen in beer which is dispensed from a tap. A contactor module containing hollow fiber membranes is utilized to allow the control of dissolving the gases in the liquid, e.g., in beer in the flow line of the beer from the keg to the tap. Beer flows from the keg to one side of the hollow fiber membranes in the contactor module, preferably, to the shell side of the hollow fibers. A supply of at least one gas source is placed under pressure and supplied to the other side of the membranes from the beer, preferably, to the bores of the hollow fibers. When supplying gases under pressure to the non-liquid side of the hollow fibers, a system of control valves is used. Each of these control valves is a "three way valve", each with one continuously open port to provide connection to the contactor module either directly or through another like valve. The preferred embodiment has three of these control valves. The continuously open port of the first valve is connected directly to the contactor module. The first valve controls gases entering the contactor module and leaving the contactor module through a port 2. A switch in the first valve connects the port 2 to either a port 3 or a port 1. The second valve through its continuously open port 5 is connected to the first valve at the port 1 of the first valve. The second valve controls the flow of the gas hereinafter called GAS 2 through its port 4 to the contactor module and controls the exit of gases from the contactor module through its port 6. The third valve through its continuously open port 8 is connected to the first valve at the port 3 of the first valve. The third valve controls the flow of the gas hereinafter called GAS 1 through its ports 7 and 9. The function of each of the ports 7 and 9 will be further described hereinafter.

The apparatus and system (process) described above allows the beer to contain preselected amounts of nitrogen and carbon dioxide dissolved in the beer and present at the dispense of the beer from the tap, allowing dispense of the beer as frequently as every 8 to 10 seconds.

In one embodiment, the liquid is placed under a predetermined pressure and transported into the shell side of the contactor module containing hollow fiber membranes. The bores of the hollow fibers contain a gas which is soluble in the liquid, the gas being under a predetermined pressure. If it is desired to raise the level of the gas dissolved in the liquid, the partial pressure of the gas in the bores of the fibers is maintained higher than the equilibrium partial pressure of the gas in the liquid in the shell side of the module. On the other hand, if it is desired to lower the level of the gas dissolved in the liquid the partial pressure of the gas in the bores of the fibers is maintained lower than the equilibrium partial pressure of the gas in the liquid in the shell side of the module.

Suitable permeable hollow fibers used in the contactor module permit a high degree of flexibility of operation in respect of bore pressure and shell pressure, while retaining true bubble-less transfer of gases. Thus it is possible to achieve high rates of mass transfer of gas, irrespective of liquid pressure variation on the shell side. The liquid pressure only limits the ultimate equilibrium level of gas which can be dissolved in the liquid.

DETAILED DESCRIPTION OF THE INVENTION

Figure 1:
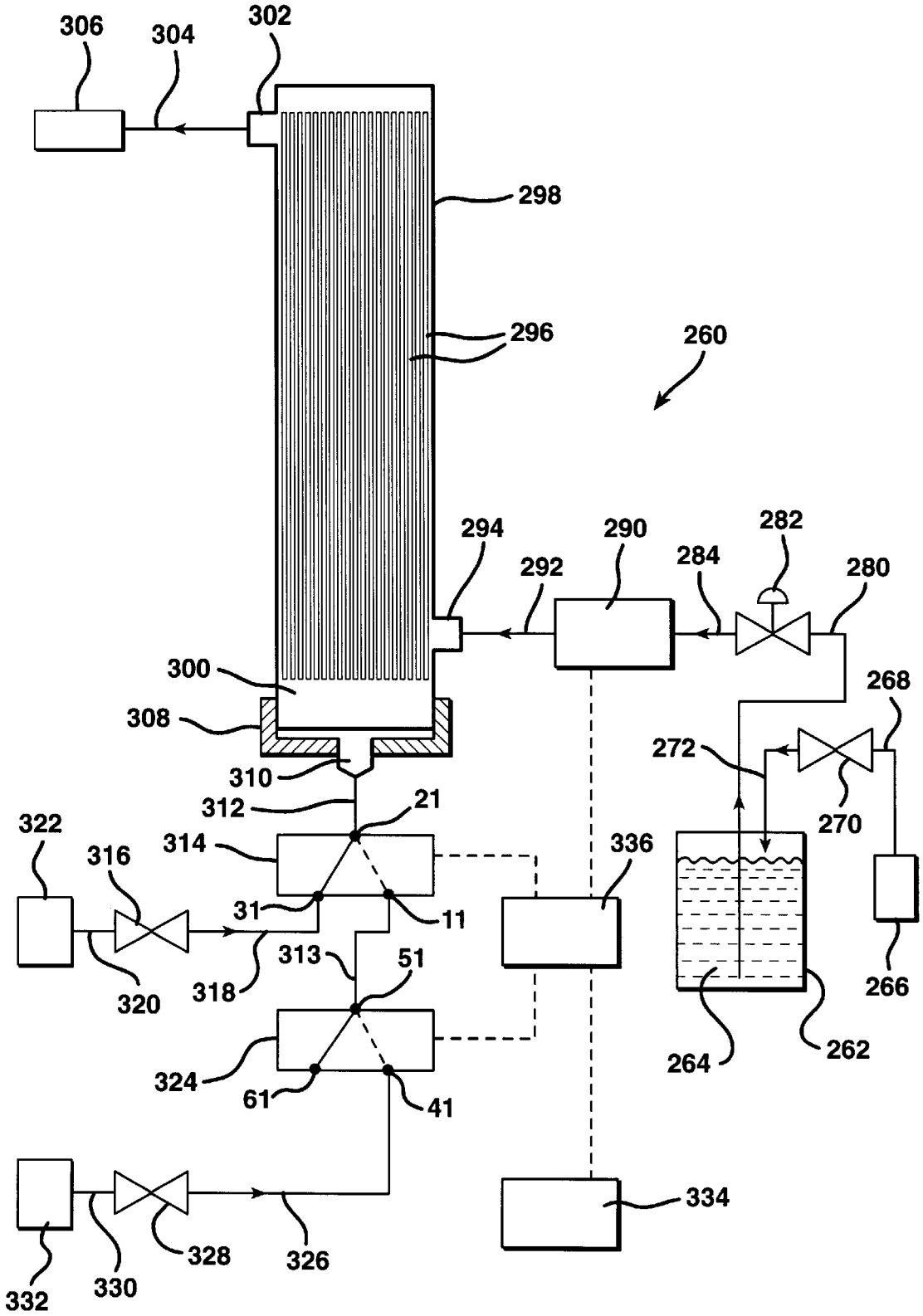
FIG. 1 PRIOR ART
FIG. 1 is a schematic of a prior art process of U.S. Pat. No. 5,565,149.

A prior art process 260 from U.S. Pat. No. 5,565,149 is depicted in FIG. 1. In this instance, a single contactor module 298 is used. A keg 262 of beer 264 is maintained under pressure of a gas supplied from a gas source 266 through a line 268 to a control valve 270 and hence through another line 272 into the head space of the keg 262. The gas pressure is maintained at a predetermined level sufficient to provide adequate flow of the beer 264 through a line 280. The beer 264 flows from the line 280 through a check valve 282 and through another line 284 to a flow switch 290. The flow switch 290 cooperates with the control unit 336 such that when the dispense system 306 is activated, the flow switch 290 allows beer to flow into the contactor module 298 through the line 292 into the shell side entry port 294. The shell side of the fibers 296 in the contactor module 298 remains full of beer at all times under pressure whether the dispense system is drawing beer or whether the beer is static or motionless in the module.

The hollow fibers 296 in the module 298 penetrate the tubesheet 300 into a port 310, through the capped end 308 of the module 298, wherein gas under pressure either leaves the bore side of the hollow fibers or is fed to the bore side of the fibers. A gas supply line 312 is connected to a three-port control valve 314. The valve 314 has three ports 11, 21 and 31. The port 31 receives nitrogen and the connection between the port 31 and the port 21 is opened and closed in response to the control unit 336. In a line 318 supplying nitrogen under pressure to the port 31, the nitrogen is maintained under a constant predetermined pressure controlled by the control valve 316. Nitrogen is supplied from a source 322 of nitrogen to the control valve 316 through a line 320. The connection between the hollow fiber bores and the port 21 is open at all times and receives gas from the connection from the port 31 or the connection from the port 11 or from the hollow fiber bores through the line 312 when gas is being discharged from the bore side of the fibers.

A second three-port control valve 324 has ports 41, 51 and 61. The port 51 of the valve 324 is connected by a line 313 to the port 11 of the valve 314. Carbon dioxide is supplied from a source 332 under pressure through a line 330 to a pressure regulating valve 328, which is of the relieving type to a line 326. The carbon dioxide is maintained at a constant predetermined pressure in the line 326 controlled by the pressure regulating valve 328. When the beer in the contactor module 298 remains static, the flow switch 290 is closed, and the connections to the ports 21 and 31 of the valve 314 are open to supply nitrogen under pressure through the bores of the hollow fibers so as to nitrogenate the beer in the manner discussed heretofore. When the dispense system activates and beer flows out of the contactor module 298 through the exit port 302 and line 304 to the dispense system 306, the flow switch 290 opens, the connection to the port 31 of the valve 314 closes and the connection to the port 11 opens simultaneously with the opening of the connections to the ports 51 and 61 to allow the excess nitrogen pressure to bleed from the fiber bores. The controls 336 are pre-set to allow that reduction in pressure before the operation of the valve 324 commences. This generally takes less than two seconds. Next the connection to the port 61 closes and the connection to the port 41 opens to allow the flow of carbon dioxide from the port 11 to the connection to the port 21 into the module 298. To complete the flow of carbon dioxide from the line 326 the connections to the ports 41 and 51 of the valve 324 open while the connections to the ports 11 and 21 of the valve 314 are open.

When the dispense system deactivates and the flow switch 290 closes, the connection to the port 41 of the valve 324 closes and the connection to the port 61 of the valve 324 opens to allow excess carbon dioxide to bleed from the bores of the hollow fibers 296 in the contactor module 298 After the pressure lowers to a predetermined level the connection to the port 11 closes and the connection to the port 31 of the valve 314 opens to again nitrogenate the static beer in the contactor module 298. Thus the beer is nitrogenated when it is in a static state in the contactor module which requires a minimum of about 40 seconds and any desired carbonation takes place while the beer is being dispensed. Power to the process is supplied by a power source 334 to the control unit 336 and any other points in the process 260 requiring power.

When practicing the prior art process of FIG. 1, the nitrogen gas is regulated at a pressure from about 20 to about 40 psi. The nitrogen partial pressure determines the ultimate concentration of nitrogen dissolved in the beer. The process of nitrogenation is about 50% completed in about 17 or 18 seconds and about 80% completed in about 40 seconds, and close of 100% in one minute or more. In pubs and restaurants, dispense of beer from the tap frequently occurs at intervals of less than one minute. For instance, dispense of beer may occur as frequently as every 8 or 10 seconds. When utilizing the process of FIG. 1, the level of any dissolved gas will not have reached the desired level when the dispense intervals are so short.

Figure 2:
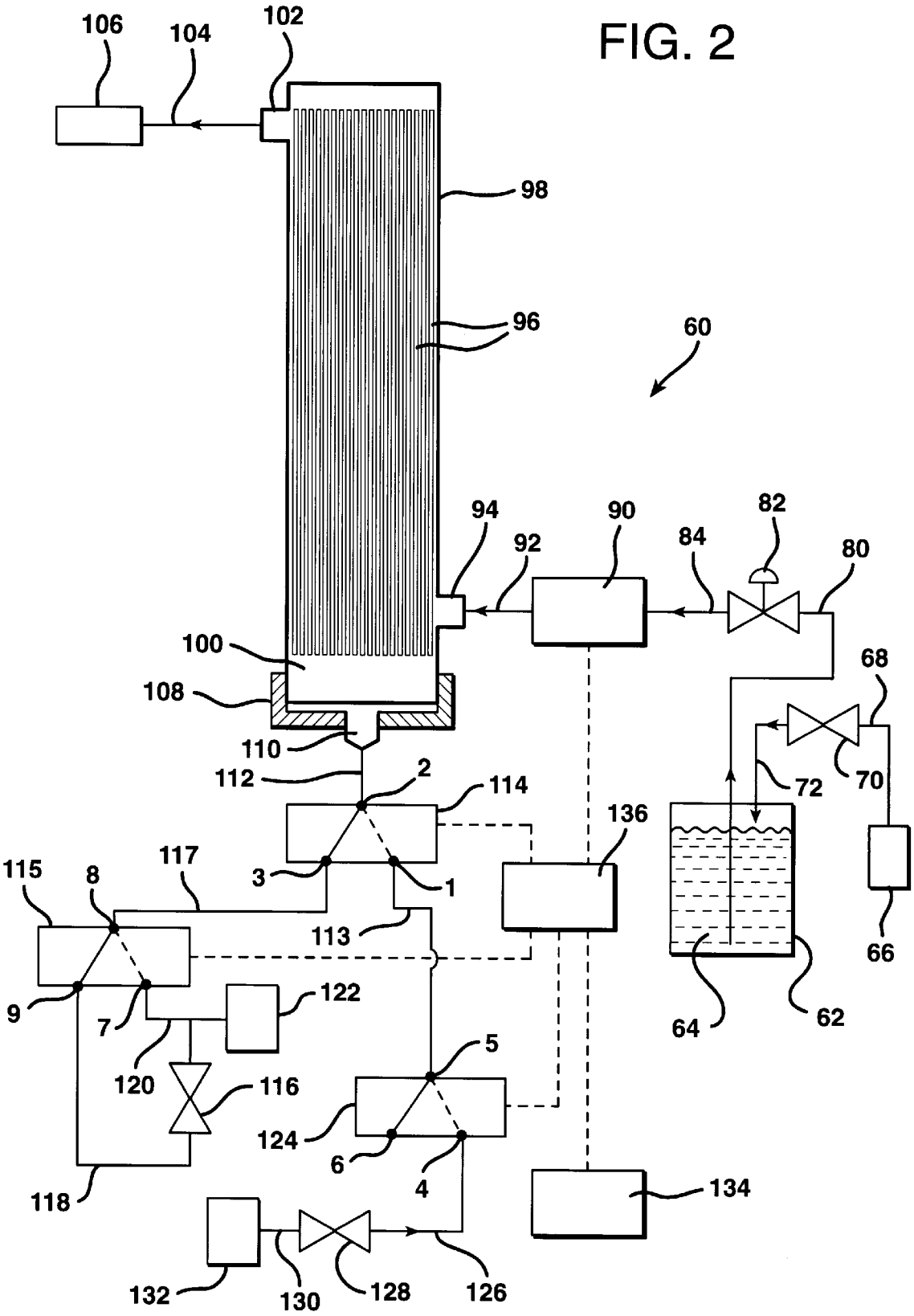
FIG. 2 is a schematic of one embodiment of the present invention.

A particularly desirable process 60 in accordance with the present invention, is depicted in FIG. 2, showing an example where the dissolved levels of both nitrogen and carbon dioxide in the beer are to be controlled. It is also to be understood that the invention permits many variations of processes for control of dissolved gases, including control of only a single dissolved gas level such as the carbon dioxide level. In the instance shown in FIG. 2, a single contactor module 98 is used. The module 98 is a suitable module which allows gas to transfer from one side of the hollow fiber membranes to the liquid residing on the other side of the hollow fiber membranes. In this particular instance, the gas is in the hollow fiber bores and the beer is on the shell side of the hollow fibers. A keg 62 of beer 64 is maintained under pressure of a gas (either carbon dioxide or nitrogen or a combination of carbon dioxide and nitrogen) supplied from a gas source 66 through a line 68 to a control valve 70 and hence through another line 72 into the head space of the keg 62. The pressure in the keg is maintained at a predetermined level sufficient to provide adequate flow of the beer 64 through a line 80. In some instances an electrically or pneumatically operated pump may be used to transport the beer through the contactor module to the dispense tap. The beer 64 flows from the line 80 through a check valve 82, and through another line 84 to a flow switch 90. The flow switch 90 cooperates with the control unit 136 such that when the dispense system 106 is activated, the flow switch 90 allows beer to flow into the contactor module 98 through the line 92 into the shell side entry port 94. The shell side of the hollow fibers 96 in the contactor module 98 remains full of beer at all times under pressure whether the dispense system is drawing beer or whether the beer is static or motionless in the contactor module 98.

The hollow fibers 96 in the contactor module 98 penetrate the tubesheet 100 into a port 110, which port exits through the capped end 108 of the module 98, wherein gas under pressure either leaves the bore side of the hollow fibers or is fed to the bore side of the fibers through the port 110.

Gases from two supply sources 122 (GAS 1) and 132 (GAS 2), are used to provide the desired quantity of dissolved carbon dioxide and, optionally, nitrogen in the beer. The gas supply sources, 122 and 132, may each contain carbon dioxide or nitrogen or the same or different mixtures of both carbon dioxide and nitrogen. Because it is more difficult to dissolve nitrogen in a liquid than it is carbon dioxide, it has been found desirable to establish the control system which is provided by the present invention so as to allow rapid successive draws from the tap and still provide the desired levels of dissolved gas in the drawn beer.

A gas supply line 112 is connected to a three-port control valve 114 having ports 1, 2 and 3. The port 2, continuously open, either receives gas under a predetermined pressure to supply to the contactor module through the line 112 or allows gas to leave the contactor module according to the dictates of the control unit 136. The control unit 136 controls the entire process for switching each of the control valves 114, 115 and 124. The valve 114 changes the flow of gas from the port 1 to the port 2 or from the port 3 to the port 2. The flow of the GAS 1 under pressure flows from its gas source 122 through a line 120 to either the port 7 or the port 9 of the valve 115 and thence through the port 8 to the line 117 to the port 3, on to the port 2 and into the contactor module 98 through the line 112. In a line 118 supplying gas from the source 122 under pressure to the port 9, the gas is maintained under a constant predetermined pressure controlled by the pressure control valve 116. When the control valve is set to permit flow from the port 7 to the port 8, the predetermined pressure of the gas source 122 supplies the pressure of the GAS 1 to the port 8 at that predetermined pressure. The control valve 115 is always open at the port 8. The GAS 1 is supplied from the source 122 at one of two predetermined pressures. The choice of whether the pressure is supplied according to that of the supply source 122 or that determined by the pressure control valve 116 is made by the control unit 136 according to the frequency of the draws of beer from the tap 106. The pressure control valve 116 is a relieving type valve.

The pressure setting from the gas source 122 (GAS 1) is higher than the pressure setting of the valve 116 so that if the draws of beer are rapid with little time between them, the higher pressure of the GAS 1 is fed directly through the line 120 and the port 7 to the open port 8 and hence through the control valve 114 to the module 98 containing the hollow fiber membranes 96. The connection between the hollow fiber bores and the port 2 is open at all times and receives gas from the connection from the port 3 or the connection from the port 1 or from the hollow fiber bores through the line 112 when gas is being discharged from the bore side of the fibers.

Another three-port control valve 124 has ports 4, 5 and 6. The port 5 of the valve 124 is connected by a line 113 to the port 1 of the valve 114. The GAS 2 (which may or may not contain nitrogen) is supplied from a source 132 under pressure through a line 130 to a pressure regulating valve 128, which is also of the relieving type to a line 126. The GAS 2 is maintained at a constant predetermined pressure in the line 126 controlled by the pressure regulating valve 128. When the flow switch 90 is closed, the beer in the contactor module 98 remains static and the connections to the ports 2 and 3 of the valve 114 are open to supply the GAS 1 under pressure through the bores of the hollow fibers so as to add the dissolved GAS 1 to the beer in the manner discussed heretofore.

When the dispense system activates and the flow switch 90 opens and beer flows out of the contactor module 98 through the exit port 102 and the line 104 to the dispense system 106, the connection to the port 3 of the valve 114 closes and the connection to the port 1 opens simultaneously with the opening of the connection to the ports 5 and 6 to allow the excess GAS 1 pressure to bleed from the fiber bores. The time required to reduce the bore pressure to substantially that of the atmosphere is dictated by the size of the internal passageways in the valve 114. The controls 136 are pre-set to allow that reduction in pressure before the operation of the valve 124 commences. This, preferably, is completed in less than about two seconds. Next the connection to the port 6 closes and the connection to the port 4 opens to allow the flow of GAS 2 from the port 1 to the connection to the port 2 into the module 98. To complete the flow of GAS 2 from the line 126, the connections to the ports 4 and 5 of the valve 124 open while the connections to the ports 1 and 2 of the valve 114 are open. The level of GAS 2 dissolved in the beer is controlled as discussed heretofore.

When the dispense system deactivates and the flow switch 90 closes, the connection to the port 4 of the valve 124 closes and the connection to the port 6 of the valve 124 opens to allow excess GAS 2 to bleed from the bores of the hollow fibers 96 in the contactor module 98. After the pressure lowers to a predetermined level the connection to the port 1 closes and the connection to the port 3 of the valve 114 opens to again add dissolved GAS 1 to the static beer in the contactor module 98. By venting any of the residual GAS 2 and GAS 1 from the hollow fiber bores at the points of transition between the stopping and the starting of the flow of beer at dispense, development of gradients of partial pressures of these gases along the length of the fibers is minimized or avoided and the condition for controlling these dissolved gas levels are identical from one dispense operation to the next. Power to the process is supplied by a power source 134 to the control unit 136 and any other points in the process 60 requiring power.

In the event that the carbon dioxide content of the beer reaching the contactor module 98 is too high, the regulator valve 128 also operates to trim such over-carbonation. Carbon dioxide permeates from solution in the beer through the walls of the hollow fibers into the bore volume, and this excess carbon dioxide is vented at the relieving regulator valve 128 as the valve maintains the selected bore pressure in the module 98.

In the course of the dispense of one glass or mug of beer the following steps occur:

1. Before the dispense commences, the beer is motionless or static, but the GAS 1 is applied during the static state and moves through the ports and valves as follows: 9→8→3→2. and thence into the fiber bores to dissolve this gas in the beer while waiting for the dispense event to begin.

2. When dispense begins, the following flow of gas from the hollow fiber bores takes place. 2→1→5→6. This vents the bores and requires only from 1–2 seconds.

3. Dispense continues and the nitrogenation and carbonation levels are established by the following flow of the GAS 2: 4→5→1→2 This takes about 1–2 seconds.

4. The dispense ends and the bores of the hollow fibers are vented as in Step 2.

5. After the venting of the fiber bores, accelerated gas solution in the beer now contained in the contactor module occurs by the following route: 7→8→3→2 This condition is maintained for a duration of about 4–8 seconds depending on the gas transfer kinetics within the hollow fiber membranes in the contactor module under "no flow" conditions and the available pressure of the GAS 1 contained in the source 122.

6. The system returns to the original static state as in Step 1, by relief of the applied pressure of the GAS 1 in Step 5 through the relieving pressure control valve 116, until the next dispense event when the system repeats all of the steps.

It should be noted that in Step 5, the beer in the contactor module is subjected to the full pressure of the GAS 1 from the source 122. The pressure of this gas is normally chosen to be in the range from about 60 to about 90 psig so that an equilibrium dissolved level of the GAS 1 is closely approached at the end of the operating duration of the valve 115. At the end of the operating duration of the valve 115, the system returns to its static state with the GAS 1 pressure being regulated by the control valve 116 to maintain that equilibrium level of the dissolved GAS 1 until the next dispense event.

In the operation of the invention for adding only a single gas to the beer, for example, only carbon dioxide, then a single source of that gas would be used and connected to the pressure control valve 128, and the pressure control valve 116 and the valve 115. The pressure of that single source would then be chosen in the same range as described above, and operation of the system would be as described above in Steps 1 through 6. If the beer to which only carbon dioxide is to be added further contains no dissolved nitrogen, then steps 2 and 4 above optionally could be omitted in the process.

During dispense of beer from a keg, the proportion of gas in the head space to liquid changes. As the beer level in the keg decreases the carbonation level of the beer may also change. In the practice of the present invention, the dissolved carbon dioxide content of the beer remains substantially level so that the first glass drawn from the keg and the last will be carbonated to substantially the same degree. If nitrogen gas is used at the gas source 66 in FIG. 2 to displace a carbonated beer from a keg, the quantity of carbon dioxide in the head space of the keg will change during dispense of its contents. Thus the carbonation level of the beer also will be reduced, especially if the dispense pattern empties the keg slowly.

Using the present invention, nitrogenation of the beer and control of the carbonation of the beer occur substantially instantaneously. The contactor module preferably should hold more than about 25% up to about 75% of the volume of one typical beer dispense. In this manner, the nitrogenated beer is swept from the module on each dispense thereby preventing nitrogen gradients along the length of the hollow fibers and ensuring reproducible conditions for each dispense event.

Because nitrogen is about 60 times less soluble than carbon dioxide, it is found that the level of pre-dissolved nitrogen in a given type of beer is less critical to high quality dispense presentation than is the level of carbonation. For example, the nitrogenation level may vary by a factor of two or so, e.g., from about 10 to about 80 ppm and preferably from about 30 ppm to about 60 ppm by weight without impairing presentation of the dispensed beer. Carbonation levels, however, should be maintained to within about 0.2 volume of the nominal level. Depending on the beer type, this nominal level will be set at a value between about 1.0 and about 2.5 carbon dioxide volumes per volume of beer. Control of carbonation in the present invention means either (1) the full addition of the required carbonation starting from zero or (2) incremental adjustment, up or down, to achieve the required nominal level. It should be noted that at all times until after dispense, the dissolved gases, nitrogen and carbon dioxide, are in bubble-less form and remain at the predetermined levels. Immediately, upon dispense, the carbon dioxide bubbles and the nitrogen bubbles form to provide a head on the beer.

It is generally agreed that high quality presentation in a beer drink means there is a distinct, white foam head formed on the surface when the drink is dispensed, and that this head should persist as long as possible. If the bubbles making up this foam are small, they also adhere in an attractive manner to the side of the glass while the drink is consumed. This is called "lacing".

As the beer is dispensed, nitrogen gas, which has a low solubility and which has been pre-dissolved in the beer at elevated pressure, very rapidly precipitates out of solution in a very fine dispersion of small bubbles. Larger carbon dioxide bubbles also are precipitated at the same time. The very small nitrogen bubbles float more slowly to the beers surface than the larger carbon dioxide bubbles. Some nitrogen bubbles also nucleate precipitation of dissolved carbon dioxide gas which enters them causing them to grow and float faster. The small bubbles which collect at the surface contain nitrogen and a mixture of carbon dioxide and nitrogen gases. Because nitrogen is less able to permeate through the bubble's walls due to its low solubility these bubbles are relatively stable. Although the bubbles are losing carbon dioxide by permeation to the atmosphere, that loss tends to be made up by further carbon dioxide arriving from the bulk of the beer in the glass. Therefore the "head" on a nitrogenated beer lasts longer and is more appealing to most customers.

In addition to securing consistent dispense quality the amount of nitrogen required is limited to the amount dissolved in the beer. For instance, if a bar or lounge were to dispense 10,000 gallons of beer with the amount of nitrogen being 50 ppm, the annual nitrogen usage utilizing the present invention would be less than 3 cubic meters compared with over 84 cubic meters of nitrogen if the same sales were made using a mixed gas of 50% nitrogen and 50% carbon dioxide dispensing at 40 psig. Thus it can be seen that the present invention not only provides a more satisfactory product in the eyes of the customer but also conserves nitrogen.

It may be desirous to use nitrogen as the head pressure in a keg or vat to transport an initially flat beer to a contactor module to nitrogenate and/or carbonate the beer. Generally nitrogen is cheaper than carbon dioxide and brewers find flat beers easier to handle than fully carbonated beers. During the dwell time of the beer, typically three days under the pressure of nitrogen in the keg, little or no nitrogen is dissolved in the beer. In order for significant dissolution of the nitrogen into the beer to take place, the contact interface area needs to be large and the partial pressure of the gas in relation to the partial pressure of the same gas already dissolved in the liquid needs to be increased.

A top pressure of a mixed nitrogen/carbon dioxide gas alternatively can be used to dispense keg beers. The carbon dioxide partial pressure is set to a predetermined level and nitrogen makes up the remainder pressure needed to transport the beer. In this manner there is substantially no net change in the level of carbonation of the beer. However, there can be no appreciable dissolution of nitrogen into the beer so unless the beer is already nitrogenated by the brewery, use of the present invention is necessary to achieve the desired level of nitrogenation for satisfactory presentation of the beer. Furthermore, as the beer in the keg is dispensed, the carbonation level of the beer decreases to come into equilibrium with the carbon dioxide level in the head space in the keg. However, when using the present invention, the carbonation level of the beer is substantially even.

Some brewers now nitrogenate certain of their beer products. These most generally are dispensed with a nitrogen/carbon dioxide mixed gas as the keg top pressure gas. But the ratio of nitrogen to carbon dioxide gases and the pressure used are still calculated to provide the correct carbon dioxide "balance" pressure and thus, without the present invention, the system does not have the degree of freedom to also provide a target nitrogen "balance" pressure which may correspond to a dissolved nitrogen concentration of between 10 and 60 ppm by weight. The role of dissolved nitrogen is to produce a tighter and more stable foam (head) on dispense, as has been explained.

The entire process of the present invention is bubble-less throughout until the liquid is dispensed. This is accomplished utilizing hollow fiber membranes in the contactor modules. The membranes must be non-floodable under the pressure conditions of use. Since there is liquid on one side of the membrane and gas on the other, it is necessary that the liquid not flood the side of the hollow fiber membranes containing the gas. Also the membranes should have satisfactory permeability for each of carbon dioxide and nitrogen so as to permit useful rates of mass transfer of the gas to the liquid.

EXAMPLE 1

Previously in U.S. Pat. No. 5,565,149, in Example 3 in accordance with FIG. 1, a lager beer with an initial carbonation of 2.4 v/v (volume of carbon dioxide to volume of beer) is made. The beer is stored in a keg at 50° F. The beer line pressure is 30 psig derived from a nitrogen top pressure on the beer keg giving a dispense flow rate of 1.4 liters/minute. A cooler fitted in the beer line produces a temperature of 45° F. If the beer is dispensed at one minute intervals the carbon dioxide content of a 20 oz. drink (591 ml) is about 2.56 v/v. When the dispensing interval is reduced to every 7 seconds, the drink carbonation decreases to 2.15 v/v resulting in a less desirable drink.

The same beer and dispensing conditions are applied using the present invention as shown in FIG. 2. The contactor module 98 has a shell volume capacity of about 200 ml on the shell side. The carbon dioxide source 122 is at a pressure of 72 psig whereas the pressure of the line 118 controlled by the valve 116 is 15 psig and for the line 113 controlled by the valve 128, the carbon dioxide pressure is 19 psig. When the carbon dioxide gas enters the hollow fibers utilizing the pressure of 72 psig, the valve openings in the valves 114 and 115 are 7→8→3→2. The pressure of 72 psig of carbon dioxide gas from the gas source 122 via the line 120 is applied after the dispensing event for about 6.5 seconds whereupon the carbonation of each drink of 20 oz. (591 ml) dispensed at 7 second intervals is 2.56 v/v.

EXAMPLE 2

A beer, stored in a keg at 50° F. with a carbonation level of 1.0 v/v, is required to be carbonated to a level of 1.6 v/v and also nitrogenated prior to dispense in order to produce an enhanced presentation effect with a tight and stable foam structure (head). The beer dispense flow rate from the keg is 1.25 liters/minute via an electrically driven pump. Using the prior art process shown in with FIG. 1, a mixed gas having 50% carbon dioxide and 50% nitrogen at a regulated pressure of 28 psig is applied as the GAS 1 and 100% carbon dioxide gas at a regulated pressure of 16.5 psig is applied as the GAS 2. The correct drink carbonation and required presentation effects of the beer are obtained in successive 20 oz. drinks (591 ml) provided the interval between dispenses from the tap is greater than 40 seconds. When this interval is reduced, it is noted that the nitrogenation effects are diminished, and can only be restored by returning to approximately 40 second intervals between dispensing.

The same beer and dispensing conditions are then applied using the present invention process depicted in FIG. 2, with the GAS 1 supplied to the process at a feed pressure of 65 psig. The process is controlled to provide the high pressure GAS 1 via the ports 7→8→2→3 of FIG. 2 for 5.5 seconds at the end of each dispense. The GAS 1 pressure otherwise is regulated at 28 psig and the pressure for GAS 2 is regulated at 16.5 psig. The interval between dispenses at the tap could be as little as approximately 6 seconds before any reduction in nitrogenation effects could be detected. The carbonation levels in the dispensed drinks are also maintained at 1.6 v/v.

Although the examples demonstrate utilization of the bore side of the hollow fiber membranes as the gas side and the shell side of the membranes as the liquid side, the present invention may be used just as effectively by using the bore side of the hollow fiber membranes for the liquid and the shell side for the gas. The driving force for gas transfer dissolution into a liquid is the difference between the partial pressure of the gas on the gas side of the hollow fiber membranes and the vapor pressure of that gas on the liquid side of the hollow fiber membranes.

The present invention is applicable to any liquid in which it is desired to dissolve a gas. For example, high levels of dissolved carbon dioxide in water is required at soda fountains when making ice cream sodas, or fountain sodas made with a syrup and carbonated water. Carbonation of certain wines is desirable at restaurants. In this case a non-carbonated wine can be supplied in a large container from which the wine can be dispensed via the system of the present invention.

At health centers, vitamin containing beverages can be dispensed under pressure wherein it is desirable to dissolve oxygen. If the oxygen is dissolved in the beverage before storage, the oxygen will reduce the effectiveness of the vitamins by causing oxygenation breakdown of the vitamins, but when utilizing the present invention, the oxygen is dissolved in the beverage just before dispense and consumption of the beverage.

What is claimed is:

1. An apparatus for providing dispense of a beverage under pressure as often as about every 8 to 10 seconds, while maintaining a predetermined quantity of dissolved gas in the beverage, the apparatus comprising:

(a) a contactor module containing hollow fiber membranes, the module having a gas side and a liquid side;

(b) means for presenting the beverage at a predetermined pressure on the liquid side in the contactor module;

(c) a first three-way valve connecting the gas side of the contactor module to either the atmosphere or a second three-way valve, the second three-way valve being connected to a first gas source to provide either high pressure gas or nominal pressure gas for controlling the pressure of a dissolving gas in the gas side of the contactor module; and (d) means for maintaining the gas containing beverage under pressure until dispense.

2. The apparatus of claim 1 wherein the gas source is carbon dioxide or a mixture of carbon dioxide and nitrogen.

3. The apparatus of claim 1 wherein the beverage is carbonated water and the gas source is carbon dioxide.

4. The apparatus of claim 1 wherein the beverage is beer and the gas source is carbon dioxide and nitrogen.

5. The apparatus of claim 1 wherein the beverage is wine and the gas source is carbon dioxide.

6. The apparatus of claim 1 wherein the beverage is a vitamin drink and the gas source is oxygen.

7. The apparatus of claim 1 including a third three-way valve connecting the atmosphere outlet of the first valve to either the atmosphere or a second nominal pressure gas source.

8. The apparatus of claim 7 wherein the beverage is beer, the gas source is nitrogen and the second gas source is carbon dioxide.

9. The apparatus of claim 7 wherein the beverage is beer, the gas source is a mixture of carbon dioxide and nitrogen and the second gas source is carbon dioxide.

10. The apparatus of claim 7 wherein the beverage is water and both the gas sources are carbon dioxide.

11. An apparatus for providing dispense of a beverage under pressure as often as about every 8 to 10 seconds, while maintaining a predetermined quantity of dissolved gas in the beverage, the apparatus comprising:

(a) a contactor module containing hollow fiber membranes, the module having a gas side and a liquid side;

(b) means for presenting the beverage at a predetermined pressure on the liquid side in the contactor module;

(c) a first three-way valve connecting the gas side of the contactor module to either (1) a second three-way valve connected to a first gas source to provide either high pressure gas or nominal pressure gas for controlling the pressure of a dissolving gas from the first gas source in the gas side of the contactor module; or (2) a third three-way valve connected to either the atmosphere or a second nominal pressure gas source for controlling the pressure of a dissolving gas from the second gas source in the gas side of the contactor module; and (d) means for maintaining the gas containing beverage under pressure until dispense.

12. The apparatus of claim 11 wherein the beverage is beer, the first gas source is nitrogen and the second gas source is carbon dioxide.

13. The apparatus of claim 11 wherein the beverage is beer, the first gas source is a mixture of carbon dioxide and nitrogen and the second gas source is carbon dioxide.

14. The apparatus of claim 11 wherein the beverage is water and both the first gas source and the second gas source are carbon dioxide.

15. The apparatus of claim 11 wherein the beverage is wine and both the first gas source and the second gas source are carbon dioxide.

16. A process utilizing a contactor module having a gas side and a liquid side for controlling dissolved gas in a beverage which is dispensed sometimes as often as about every 8 or 10 seconds while maintaining a predetermined quantity of dissolved gas, wherein the beverage is placed in the liquid side of the contactor module under a predetermined pressure, the process which comprises:

(a) increasing the quantity of dissolved gas in the beverage by applying a gas from a gas source at a pressure from about 60 to about 90 psig to the bores of the hollow fibers for from about 4 to about 8 seconds to obtain a predetermined dissolved level of the gas in bubble-less form in the beverage while continuously maintaining the pressure of the beverage in the contactor module;

(b) reducing the pressure of the gas to a predetermined level; and (c) retaining the dissolved gas in bubble-less form in the beverage until dispense is completed into a glass or mug.

17. The process of claim 16 wherein the gas source is carbon dioxide or a mixture of carbon dioxide and nitrogen.

18. The process of claim 16 wherein the beverage is carbonated water and the gas source is carbon dioxide.

19. The process of claim 16 wherein the beverage is beer and the gas source is carbon dioxide and nitrogen.

20. The process of claim 16 wherein the beverage is wine and the gas source is carbon dioxide.

21. The process of claim 16 wherein the beverage is a vitamin drink and the gas source is oxygen.

22. A process utilizing a contactor module having a gas side and a liquid side for controlling dissolved gas in a beverage which is dispensed sometimes as often as about every 8 or 10 seconds while maintaining a predetermined quantity of dissolved gas, wherein the beverage is placed in the liquid side of the contactor module under a predetermined pressure, the process which comprises:

(a) increasing the quantity of dissolved gas in the beverage by applying a first gas from a gas source at a pressure from about 60 to about 90 psig to the bores of the hollow fibers for from about 4 to about 8 seconds to obtain a predetermined dissolved level of the gas in bubble-less form in the beverage while continuously maintaining the pressure of the beverage in the contactor module;

(b) reducing the pressure of the first gas to a predetermined level;

(c) when a dispense event begins, substantially immediately removing any residual amount of the first gas from the bores of the hollow fibers;

(d) controlling the quantity of a second gas dissolved in the beverage by increasing or decreasing the pressure of the second gas in the bores of the hollow fibers by an appropriate amount to obtain the predetermined level of the second gas dissolved in the beverage while continuously maintaining the flow and pressure of the liquid; and (e) retaining the dissolved level of each gas as the dissolved gas in bubble-less form in the beverage until dispense is completed into a glass or mug.

23. The process of claim 22 wherein the beverage is beer, the first gas source is nitrogen and the second gas source is carbon dioxide.

24. The process of claim 22 wherein the beverage is beer, the first gas source is a mixture of carbon dioxide and nitrogen and the second gas source is carbon dioxide.

25. The process of claim 22 wherein the beverage is water and both the first gas source and the second gas source are carbon dioxide.

26. The process of claim 22 wherein the beverage is wine and both the first gas source and the second gas source are carbon dioxide.

27. A process utilizing a contactor module containing hollow fiber membranes having a shell side comprised of the space surrounding the exterior of the hollow fiber membranes and filling the interior of the module and a bore side comprised of the space in the bores of the hollow fibers, for enhancing beer which is dispensed from a tap sometimes as often as about every 8 to 10 seconds while maintaining a predetermined quantity of dissolved nitrogen and dissolved carbon dioxide, wherein beer is placed in the shell side of the contactor module under a predetermined pressure, the process which comprises:

(a) increasing the quantity of dissolved nitrogen in the beer by applying nitrogen gas from a nitrogen gas source at a pressure from about 60 to about 90 psig to the bores of the hollow fibers for from about 4 to about 8 seconds to obtain a predetermined level of dissolved nitrogen in bubble-less form in the beer while continuously maintaining the pressure of the beer in the contactor module;

(b) reducing the pressure of the nitrogen gas to about 15 psig;

(c) when a dispense event begins, substantially removing residual gas from the bores of the hollow fibers;

(d) increasing or decreasing the quantity of the dissolved carbon dioxide in the beer by increasing or decreasing the pressure of the carbon dioxide in the bores of the hollow fibers by an appropriate amount to obtain the predetermined level of dissolved carbon dioxide in the beverage while continuously maintaining the pressure of the beer; and (e) retaining the dissolved carbon dioxide and dissolved nitrogen in bubble-less form in the beer until dispense is completed into a glass or mug.

* * * * *